US008038844B2

(12) United States Patent
Danielsson

(10) Patent No.: US 8,038,844 B2
(45) Date of Patent: Oct. 18, 2011

(54) METHOD AND A DEVICE FOR FEEDING PULP FROM A DEWATERING UNIT

(75) Inventor: Peter Danielsson, Piteå (SE)

(73) Assignee: Metso Paper, Inc. (FI)

( * ) Notice: Subject to any disclaimer, the term of this patent is extended or adjusted under 35 U.S.C. 154(b) by 356 days.

(21) Appl. No.: 12/226,466

(22) PCT Filed: Feb. 23, 2007

(86) PCT No.: PCT/SE2007/050112

§ 371 (c)(1),
(2), (4) Date: Oct. 10, 2008

(87) PCT Pub. No.: WO2007/117202

PCT Pub. Date: Oct. 18, 2007

(65) Prior Publication Data

US 2009/0056895 A1 Mar. 5, 2009

(30) Foreign Application Priority Data

Apr. 10, 2006 (SE) ..... 0600826

(51) Int. Cl.
*D21F 11/00* (2006.01)

(52) U.S. Cl. ..... 162/158

(58) Field of Classification Search ..... 162/158, 162/232, 252, 17, 18, 19, 261
See application file for complete search history.

(56) References Cited

U.S. PATENT DOCUMENTS

| | | | | |
|---|---|---|---|---|
| 3,014,589 | A | 12/1961 | Fryhult | |
| 5,842,242 | A | 12/1998 | Antkowiak | |
| 2005/0224198 | A1 * | 10/2005 | Snekkenes et al. | 162/17 |

FOREIGN PATENT DOCUMENTS

| | | |
|---|---|---|
| EP | 1 584 743 A1 | 10/2005 |
| SE | 505 539 | 9/1997 |
| SE | 526 292 | 8/2005 |

* cited by examiner

*Primary Examiner* — Mark Halpern
(74) *Attorney, Agent, or Firm* — Lerner, David, Littenberg, Krumholz & Mentlik, LLP

(57) ABSTRACT

A device for feeding cellulose-containing pulp from a dewatering unit, the dewatered pulp being discharged via an outlet included in the dewatering unit to a reception means positioned below the outlet, whereupon the pulp is transported to a stand pipe via an inlet included in the stand pipe, in which stand pipe the pulp falls freely under the influence of gravity, the reception means being positioned at a higher level than the inlet of the stand pipe. At least one feeding down surface is arranged which extends from the reception means to the inlet of the stand pipe, and the transport of the pulp between the reception means and the inlet of the stand pipe is effected by feeding the pulp downwards along this feeding down surface under the influence of gravity, the pulp being diluted during the feeding of the pulp downwards.

21 Claims, 3 Drawing Sheets

METHOD AND A DEVICE FOR FEEDING PULP FROM A DEWATERING UNIT

CROSS REFERENCE TO RELATED APPLICATIONS

This application is a national phase entry under 35 U.S.C. §371 of International Application No. PCT/SE2007/050112 filed Feb. 23, 2007 and published in English as WO 2007/117202A1 which claims priority from Swedish Patent Application No. 0600826-2 filed Apr. 10, 2006, each of which are hereby incorporated by reference herein.

TECHNICAL FIELD

The present invention relates to a method for feeding cellulose-containing pulp from a dewatering unit for dewatering pulp, the dewatered pulp from the dewatering unit being discharged via an outlet, included in the dewatering unit, to a reception means for receiving the dewatered pulp, which reception means is positioned below the outlet. The pulp is transported from the reception means to a stand pipe via an inlet included in the stand pipe, in which stand pipe the pulp falls freely under the influence of gravity, the reception means being positioned at a higher level than the inlet of the stand pipe. Further, the present invention relates to a device for feeding cellulose-containing pulp from a dewatering unit for dewatering pulp, the dewatered pulp being discharged from the dewatering unit via an outlet included in the dewatering unit. The device comprises a reception means for receiving the dewatered pulp discharged from the dewatering unit, which receptions means is adapted to be positioned below said outlet, and a stand pipe provided with an inlet, in which stand pipe the pulp falls freely under the influence of gravity. The device is arranged to transport pulp from the reception means to the inlet of the stand pipe, and the reception means is positioned at a higher level than the inlet of the stand pipe. The present invention also relates to a plant for treating cellulose-containing pulp, comprising a dewatering unit for dewatering pulp provided with an outlet for discharging dewatered pulp from the dewatering unit, and a device, as disclosed above, for feeding pulp from the dewatering unit.

BACKGROUND OF THE INVENTION

When treating cellulose-containing pulp in a line, the pulp is subjected to chemical treatment, such as bleaching, whereupon the pulp is washed and subsequently dewatered. Afterwards, the dewatered pulp is diluted to enable onward transport by pumping to next treatment step in the line. The next treatment step can, for example, be further washing of the pulp with a new filtrate.

For washing and dewatering the pulp, a dewatering unit is used, which can consist of a conventional roll press comprising two press rolls, as disclosed in SE 505 539, e.g., or a conventional washing apparatus having a single dewatering drum, as disclosed in U.S. Pat. No. 3,014,589, e.g. The pulp dewatered in the dewatering unit is fed to a shredder screw, included in the dewatering unit, to be shredded there because of its high degree of dewatering, whereupon the shredded dewatered pulp is discharged via an outlet for onward transport and treatment. To enable onward transport by pumping to the next treatment step in a line, the dewatered pulp is diluted after its discharge from the outlet of the dewatering unit. Since the dewatered pulps has a high pulp consistency and is compact, the dilution has conventionally been effected by feeding the pulp via a dilution screw where dilution fluid is added at the same time as the pulp is shredded by the dilution screw, whereby the pulp obtains a suitable consistency for pumping. From the dilution screw the pulp is subsequently fed to a vertically extending stand pipe positioned vertically below the dilution screw and the outlet of the dewatering unit, where the pulp falls freely to a pump provided in the bottom of the stand pipe, by means of which the diluted pulp is transported to the next treatment step in the line.

Instead of a dilution screw for diluting the dewatered compact pulp from the dewatering unit, SE 526 292 discloses the use of a modified stand pipe, in which the pulp, when falling freely, is diluted by adding dilution fluid under pressure in the form of directed fluid jets. The stand pipe is positioned vertically below the outlet of the discharge unit and its shredder screw, whereby the pulp falls from the outlet to the stand pipe via a receiving pipe.

However, there are problems with the above-mentioned dilutions of pulp. The use of a dilution screw results in increased power requirements and increased investment costs, increased maintenance work and additional mechanical treatment of the pulp, which negatively affects the properties of the pulp. The use of the modified stand pipe of SE 526 292 can cause problems in the form of foaming or frothing, which is a known problem connected with negative effects, when the dilution fluid is added in the form a fluid jets, for instance when the pulp falls freely in a stand pipe.

Further, there are problems associated with the feeding of the pulp by means of said stand pipe. Pulp falling freely brings along a large amount of air which causes problems in the pump and in subsequent equipment. Upon blockage or jamming in the stand pipe, or upon breakdown of the pump provided in the bottom of the stand pipe, which results in that the stand pipe is filled up with pulp so that the pulp level rapidly rises in the stand pipe and overflow occurs in the stand pipe, the pulp level may rise all the way to the dilution screw, or to the shredder screw via the outlet of the dewatering unit, where the latter applies, e.g., to the solution of SE 526 292. The result is clogging in the provided screw, and as a result of this, the screw can be overloaded and breakdown can occur.

THE OBJECT OF THE INVENTION

The object of the present invention is thus to provide a more efficient dilution of the cellulose-containing pulp which is fed from a dewatering unit, where the above-mentioned problems of prior dilution techniques are solved.

SUMMARY OF THE INVENTION

The above mentioned objects are achieved by providing a method of the kind described herein for feeding cellulose-containing pulp from a dewatering unit for dewatering pulp, which comprises the features of the dewatered pulp from the dewatering unit being discharged via an outlet, included in the dewatering unit, to a reception means for receiving the dewatered pulp, which reception means is positioned below the outlet, whereupon the pulp is transported from the reception means to a stand pipe via an inlet included in the stand pipe, in which stand pipe the pulp falls freely under the influence of gravity, the reception means being positioned at a higher level than the inlet of the stand pipe, wherein at least one feeding down surface is arranged which extends from the reception means to the inlet of the stand pipe, in that the transport of the pulp between the reception means and the inlet of the stand pipe is effected by feeding the pulp downwards along and on this feeding down surface under the influence of gravity, and in that the pulp is diluted by adding dilution fluid during the feeding of the pulp downwards along and on the feeding down surface.

By arranging this feeding down surface and the downward feeding along this surface at the same time as the pulp is diluted, an efficient dilution of the dewatered pulp discharged from the dewatering unit is attained. The dilution of the invention also provides a more efficient pulp feeding along the feeding down surface and thereby a more efficient feeding of pulp from the dewatering unit. This efficient dilution when the pulp is fed downwards along the feeding down surface replaces the conventional dilution screw, whereby pulp feeding from the dewatering unit can be effected directly to the stand pipe via said feeding down surface with the associated dilution. Further, foaming is radically reduced as the dilution fluid is sprayed towards a surface on which the pulp is lying, whereby the foam bubbles are broken up.

The present invention also prevents clogging in the shredder screw of the dewatering unit as a result of blockage in the stand pipe and subsequent raising of the pulp level and overflow in the stand pipe, since the stand pipe does not have to be positioned vertically below the reception means, but can be displaced from the reception means in a horizontal direction, and the risk of production stop as a result of said clogging is eliminated. Upon blockage or jamming in the stand pipe, the pulp level never reaches the reception means as the pulp instead is fed past the inlet of the stand pipe. Hereby, a more reliable feeding of the dewatered cellulose-containing pulp from the dewatering unit is attained.

The dewatering unit can, for instance, consist of a roll press having two press rolls or a washing apparatus having a single dewatering drum, and comprise a shredder screw as previously disclosed.

According to an advantageous embodiment of the method according to the present invention, the reception means comprises a portion of the feeding down surface, and the pulp being discharged from the outlet is directly received by the feeding down surface.

According to a further advantageous embodiment of the method according to the present invention, the pulp fed on the feeding down surface is laterally controlled. Hereby, a yet more controlled pulp flow between the reception means and the inlet of the stand pipe is attained, and as a result of this a more efficient pulp feeding and dilution of the pulp from the dewatering unit is attained.

Further advantageous embodiments of the method according to the present invention emerge from the dependent claims.

Further, the above mentioned objects are achieved by providing a device of the kind described herein for feeding cellulose-containing pulp from a dewatering unit for dewatering pulp, the dewatered pulp from the dewatering unit being discharged via an outlet included in the dewatering unit, which comprises the features of a reception means for receiving the dewatered pulp discharged from the dewatering unit, which receptions means is adapted to be positioned below the outlet, and a stand pipe provided with an inlet, in which stand pipe the pulp falls freely under the influence of gravity, the device being arranged to transport the pulp from the reception means to the inlet of the stand pipe, and the reception means is positioned at a higher level than the inlet of the stand pipe, the device comprising one or several dilution means for adding dilution fluid and diluting the pulp, wherein the device comprises at least one feeding down surface which extends from the reception means to the inlet of the stand pipe, in that the feeding down surface is arranged to transport pulp between the reception means and the inlet of the stand pipe by feeding the pulp downwards along and on this feeding down surface under the influence of gravity, and in that the dilution means are arranged to dilute the pulp during the feeding of the pulp downwards along and on the feeding down surface.

By said feeding down surface and dilution means, an efficient dilution of the dewatered pulp discharged from the dewatering unit is attained, as disclosed above, whereby the dilution screw an be excluded. Further, the feeding down surface provides flexibility and many possibilities with regard to the position of the dilution means and the direction of the fluid jets of the dilution means, since the dilution means can be rotatable and also movable along the feeding down surface, and thereby a flexible dilution is obtained. Advantageously, the dilution means are arranged to add dilution fluid under pressure in the form of directed fluid jets, and advantageously, the dilution means are adjustable to attain an efficient spraying of the pulp and thereby an efficient dilution and feeding of the pulp along the feeding down surface.

Further, the feeding down surface provides a controlled pulp flow between the reception means and the inlet of the stand pipe, inter alia, since the stand pipe does not have to be positioned vertically below the reception means, but can be arranged displaced from the reception means in a horizontal direction, whereby clogging in the shredder screw of the dewatering unit, or, if applicable, the dilution screw, since blockage in the stand pipe, and resulting raising of the pulp level in the stand pipe is prevented. Further, the pulp fed along the feeding down surface brings along less air in relation to pulp falling freely. Advantageously, the device comprises an opening positioned at a higher level than inlet of the stand pipe, through which opening pulp is dischargeable upon blockage in the stand pipe. Upon blockage or jamming in the stand pipe, the pulp level never reaches the reception means as the pulp instead is fed past the inlet of the stand pipe and out through said opening.

According to alternative embodiments of the feeding down surface of the device according to the present invention, the feeding down surface comprises a conveyor belt, a layer of rolls or a flow plate. In the case with the flow plate, the gravity affects the downward motion of the material flow, whereas with regard to conveyor belt and the layer of rolls, also their working speed affects the downward motion of the material flow. The flow plate can comprise several beside one another positioned plates. If the feeding down surface consists of a flow plate and this is lying in substantially the same plane, the flow plate is advantageously arranged so that its plane forms an angle of 25 to 75 degrees with the horizontal plane. Advantageously, the feeding down surface is provided with control means for laterally controlling the pulp, for example in the form of side walls provided along said flow plate.

According to an advantageous embodiment of the device according to the present invention, the reception means comprises a portion of the feeding down surface, the feeding down surface being adapted to extend under the outlet of the dewatering unit, and the feeding down surface is arranged to receive the pulp directly from said outlet. The reception means can also be designed in other ways, and can for example consist of a dilution screw or other suitable means for receiving pulp from the outlet of the dewatering unit.

Further advantageous embodiments of the device according to the present invention emerge from the dependent claims.

Further, the present invention provides a plant of the kind disclosed herein for treating cellulose-containing pulp which comprises a dewatering unit for dewatering pulp provided with an outlet for discharging dewatered pulp from the dewatering unit, and a device for feeding pulp from the dewatering unit, which device comprises a reception means for receiving the dewatered pulp discharged from the dewatering unit, which receptions means is positioned below said outlet and a stand pipe provided with an inlet, in which stand pipe the pulp falls freely under the influence of gravity, the device being arranged to feed pulp from the reception means to the inlet of the stand pipe, and the reception means is positioned at a higher level than the inlet of the stand pipe, wherein the device comprises at least one feeding down surface which extends from the reception means to the inlet of the stand pipe, in that the feeding down surface is arranged to transport pulp between the reception means and the inlet of the stand pipe by feeding the pulp downwards along and on this feeding down surface under the influence of gravity, and in that the dilution means are arranged to dilute the pulp during the feeding of the pulp downwards along and on the feeding down surface.

BRIEF DESCRIPTION OF THE DRAWINGS

The present invention will now be described, for exemplary purposes, in more detail by way of embodiments and with reference to the enclosed drawings, in which.

DETAILED DESCRIPTION OF PREFERRED EMBODIMENTS

Figure 1:
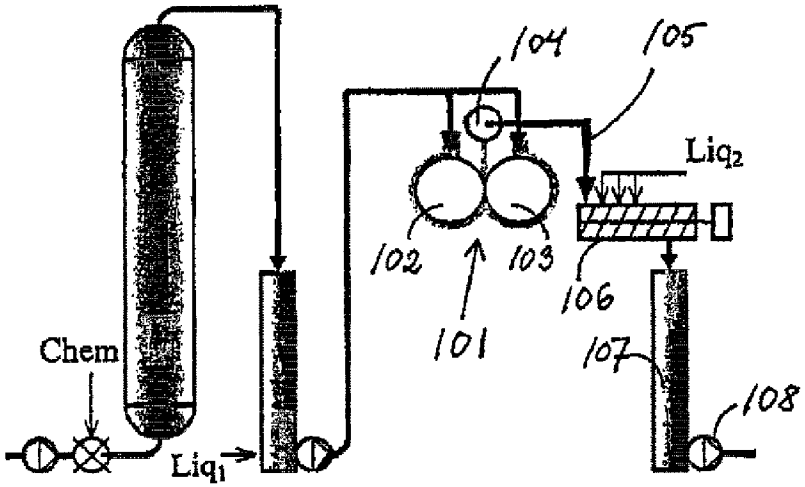
Fig.1 (PRIOR ART)
FIG. 1 is a schematic illustration of a conventional line for treating pulp according to prior art.

FIG. 1 illustrates schematically a conventional line for treating cellulose-containing pulp according to prior art, in which line cellulose pulp is washed and dewatered in a dewatering unit 101, herein in the form of a roll press 101 comprising two press rolls 102, 103. The pulp dewatered between the press rolls 102, 103 is fed to a shredder screw 104 included in the dewatering unit 101, whereupon the shredded dewatered pulp is discharged via an outlet 105 for onward transport to a reception means 106 in the form of a dilution screw 106, where dilution fluid is added at the same time the pulp is shredded by the dilution screw 106, so that the pulp obtains suitable consistency for onward transport by means of pumping. From the dilution screw 106 the pulp is subsequently fed to a vertically extending stand pipe 107 positioned vertically below the dilution screw 106, where the pulp falls freely to a pump 108 provided in the bottom of the stand pipe 107, by means of which pump 108 the diluted pulp is transported to the next step in the line.

Figure 2:
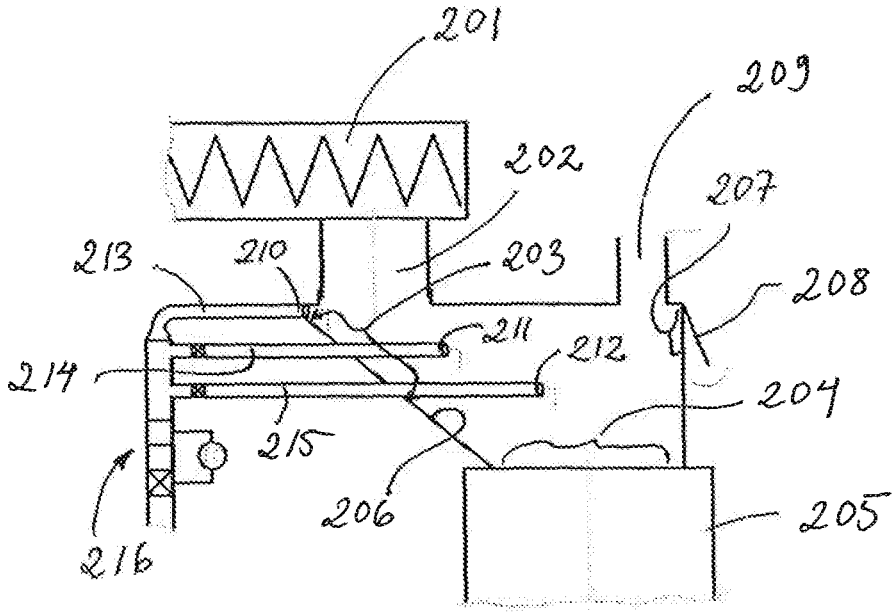
FIG. 2 is a schematic, partly cross-sectional, side view of a first embodiment of the device according to the present invention.

FIG. 2 shows an embodiment of the device according to the present invention for feeding cellulose-containing pulp from a dewatering unit. The pulp dewatered in the dewatering unit is shredded in a shredder screw 201 included in the dewatering unit and is discharged from the dewatering unit via an outlet 202 included in the dewatering unit. The device comprises a reception means 203 for receiving the dewatered pulp discharged from the dewatering unit, which receptions means 203 is adapted to be positioned below said outlet 202. Further, the device comprises a stand pipe 205 provided with an inlet 204, in which stand pipe 205 the pulp falls freely under the influence of gravity. The inlet 104 is provided highest up in the stand pipe 205, and the reception means 203 is positioned at a higher level than this inlet 204. In FIG. 2, only a part of the shredder screw 201 and the stand pipe 205 is shown.

The device comprises a feeding down surface 206, in the form of a flow plate 206, which extends from the reception means 203 to the inlet 204 of the stand pipe 205, and the feeding down surface 206 is arranged transport pulp between the reception means 203 and the inlet 204 of the stand pipe 205 by feeding the pulp downwards along and on this feeding down surface 206 under the influence of gravity. Herein, the reception means 203 comprises a portion 203 of the feeding down surface 206, and the feeding down surface 206 is adapted to extend under the outlet 202 of the dewatering unit, the feeding down surface 206 thus being arranged to receive the pulp directly from said outlet 202. The device comprises an opening 207 positioned at a higher level than inlet 204 of the stand pipe 205, through which opening 207 the pulp is dischargeable upon blockage in the stand pipe 205. Herein, the opening 207 is provided with a hinged lid 208 which, upon discharge, is opened by the discharged pulp. Above said opening 207 a ventilation opening 209 is provided to enable ventilation of the stand pipe 205.

Further, the device comprises dilution means 210, 211, 212 for adding dilution fluid and diluting the pulp, which dilution means 210, 211, 212 are arranged to dilute the pulp during the feeding of the pulp downwards along and on the feeding down surface 206. A first dilution means 210 is arranged to add dilution fluid at the reception means 203 along the feeding down surface 206, whereby dilution fluid is added to the pulp from below, whereas a second and a third dilution means 211, 212 is arranged to add dilution fluid to the pulp from above during the feeding of the pulp between the reception means 203 and the inlet 204 of the stand pipe 205. The dilution means 210, 211, 212 are supplied with dilution fluid from pipes 213, 216, 215 which are included in a pipe system 216. The pulp discharged from the outlet 202 falls between the first and the second dilution means 210, 211 and is received by the reception means 203. From the reception means 203 the pulp is fed downwards on the feeding down surface 206 between the feeding down surface 206 and the second and the third dilution means 211, 212.

Figure 3:
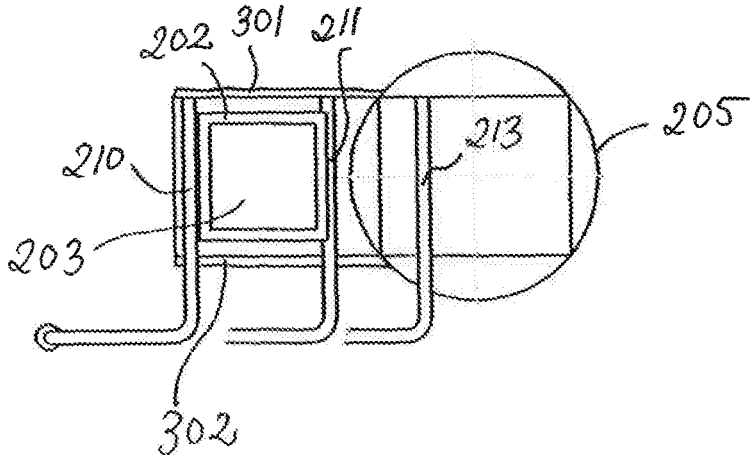
FIG. 3 is a top view of the embodiment of FIG. 2.

FIG. 3 is a top view of the embodiment of FIG. 2. Each dilution means 211, 212, 213 comprises an elongated, tubular nozzle 211, 212, 213 provided with several apertures for distributing dilution fluid. Each nozzle 211, 212, 213 extends transversely to the longitudinal direction of the feeding down surface 206. The dilution means 211, 212, 213 are arranged to add dilution fluid, via the nozzles 211, 212, 213, under pressure in the form of fluid jets directed towards the pulp fed on the feeding down surface 206. Herein, each nozzle 211, 212, 213 is rotatable around its longitudinal axis to adjust the distribution, and thereby the dilution of the pulp, but can in other cases also be movable across the feeding down surface 206. In FIG. 3 it is also shown that the feeding down surface 206 is provided with control means 301, 302, in the form of longitudinal side walls 301, 302 for laterally controlling the pulp.

Figure 4:
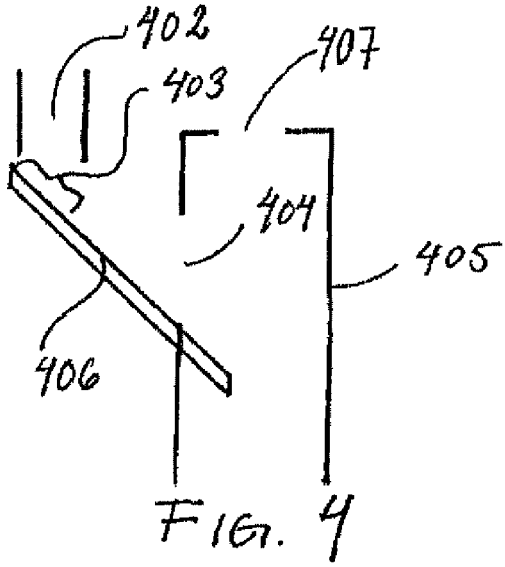
FIG. 4 is a schematic cross-sectional side view of a second embodiment of the device according to the present invention.

FIG. 4 shows a second embodiment of the device according to the present invention, where the inlet 404 of the stand pipe 405 is provided at the side of the stand pipe 405 instead of at the top of the stand pipe which is the case in the embodiment of FIG. 2. Herein, the opening 407 of the device, for discharging pulp upon blockage in the stand pipe 405 is provided at the top of the stand pipe 405. Also in FIG. 4, only a part of the stand pipe 405 is shown.

Although the feeding down surface here is designed as a flow plate, it is, of course, possible to design it in other ways as described in the summary of the invention.

Figure 5:
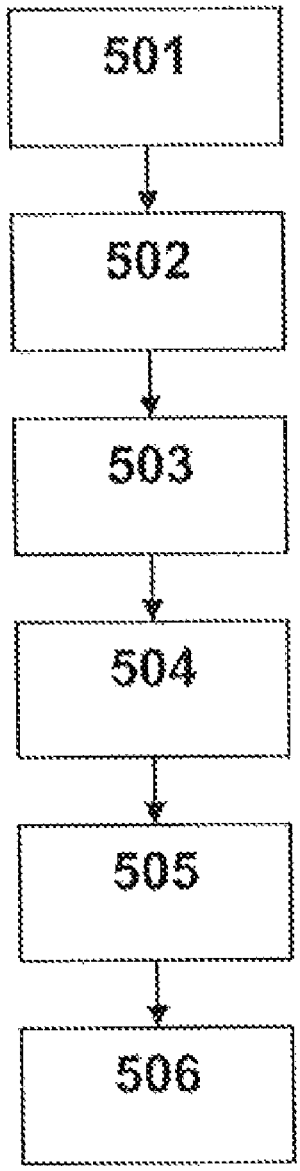
FIG. 5 is a flow diagram illustrating an embodiment of the method according to the present invention.

FIG. 5 is a flow diagram illustrating an embodiment of the method according to the present invention. The method relates to feeding cellulose-containing pulp from a dewatering unit which comprises an outlet positioned above a reception means for receiving pulp from the outlet, the pulp being transported from the reception means to a stand pipe via an inlet included in the stand pipe. The method comprises the following steps: A feeding down surface is arranged, at 501, which extends from the reception means to the inlet of the stand pipe. Cellulose-containing pulp is dewatered, at 502, in the dewatering unit, and is subsequently shredded, at 503, by a shredder screw included in the dewatering unit. The dewatered and shredded pulp is discharged, at 504, from the outlet of the dewatering unit, and is received, at 505, by reception means positioned below the outlet. From the reception means to the inlet of the stand pipe, the pulp is fed downwards, at 506, along and on the feeding down surface under the influence of gravity. When the pulp is fed downwards along the feeding downs surface, the pulp is laterally controlled at the same time as it is diluted by adding dilution fluid which is added under pressure in the form of fluid jets. This dilution fluid is added at the reception means, and dilution fluid is also added to the pulp from above during the feeding of the pulp between the reception means and the inlet of the stand pipe. By above-mentioned steps, a controlled pulp flow is attained between the reception means and the inlet of the stand pipe, whereby an efficient dilution of dewatered pulp of high pulp consistency, and an efficient pulp feeding from the dewatering unit is achieved.

The invention claimed is:

1. A method for feeding cellulose-containing pulp from a dewatering unit for dewatering pulp, the dewatered pulp from the dewatering unit being discharged via an outlet, included in the dewatering unit, to a reception means for receiving the dewatered pulp, which reception means is positioned below the outlet, whereupon the pulp is transported from the reception means to a stand pipe via an inlet included in the stand pipe, in which stand pipe the pulp falls freely under the influence of gravity, the reception means being positioned at a higher level than the inlet of the stand pipe, wherein at least one feeding down surface is arranged which extends from the reception means to the inlet of the stand pipe, in that the transport of the pulp between the reception means and the inlet of the stand pipe is effected by feeding the pulp downwards along and on this feeding down surface under the influence of gravity, and in that the pulp is diluted by adding dilution fluid during the feeding of the pulp downwards along and on the feeding down surface.

2. The method according to claim 1, wherein the dilution fluid is added under pressure in the form of fluid jets.

3. The method according to claim 1 wherein the dilution fluid is added at the reception means.

4. The method according to claim 1, wherein dilution fluid is added to the pulp from above during the feeding of the pulp between the reception means and the inlet of the stand pipe.

5. The method according to claim 1, further comprising laterally controlling the pulp fed on the feeding down surface in relation to the direction of movement of the pulp fed on the feeding down surface.

6. The method according to claim 1, wherein the reception means comprises a portion of the feeding down surface, and in that the pulp, which is discharged from the outlet, is directly received by the feeding down surface.

7. The method according to claim 1, wherein the stand pipe is arranged displaced from the reception means in a horizontal direction.

8. The method according to claim 1, wherein the feeding down surface is sloped.

9. A device for feeding cellulose-containing pulp from a dewatering unit for dewatering pulp, the dewatered pulp from the dewatering unit being discharged via an outlet included in the dewatering unit, which device comprises a reception means for receiving the dewatered pulp discharged from the dewatering unit, which receptions means is adapted to be positioned below said outlet, and a stand pipe provided with an inlet, in which stand pipe the pulp falls freely under the influence of gravity, the device being arranged to transport the pulp from the reception means to the inlet of the stand pipe, and the reception means is positioned at a higher level than the inlet of the stand pipe, the device comprising one or several dilution means for adding dilution fluid and diluting the pulp, wherein the device comprises at least one feeding down surface which extends from the reception means to the inlet of the stand pipe, in that the feeding down surface is arranged to transport pulp between the reception means and the inlet of the stand pipe by feeding the pulp downwards along and on this feeding down surface under the influence of gravity, and in that the dilution means are arranged to dilute the pulp during the feeding of the pulp downwards along and on the feeding down surface.

10. The device according to claim 9, wherein the dilution means are arranged to add dilution fluid under pressure in the form of fluid jets.

11. The device according to claim 9, wherein at least one dilution means is arranged to add dilution fluid at the reception means.

12. The device according to claim 9, wherein at least one dilution means is arranged to add dilution fluid to the pulp from above during the feeding of the pulp between the reception means and the inlet of the stand pipe.

13. The device according to claim 9, wherein each dilution means comprises an elongated nozzle provided with several apertures for distributing dilution fluid, and in that this nozzle extends transversely to the longitudinal direction of the feeding down surface.

14. The device according to claim 13, wherein the nozzle is rotatable around its longitudinal axis.

15. The device according to claim 9, wherein the feeding down surface is provided with control means for laterally controlling the pulp in relation to the direction of movement of the pulp fed on the feeding down surface.

16. The device according to claim 9, wherein the device comprises an opening positioned at a higher level than inlet of the stand pipe, through which opening pulp is dischargeable upon blockage in the stand pipe.

17. The device according to claim 9, wherein the reception means comprises a portion of the feeding down surface, in that the feeding down surface is adapted to extend under the outlet of the dewatering unit, and in that the feeding down surface is arranged to receive the pulp directly from said outlet.

18. The device according to claim 9, the stand pipe is arranged displaced from the reception means in a horizontal direction.

19. The device according to claim 9, wherein the feeding down surface is sloped.

20. A plant for treating cellulose-containing pulp, comprising a dewatering unit for dewatering pulp provided with an outlet for discharging dewatered pulp from the dewatering unit, and a device for feeding pulp from the dewatering unit, which device comprises a reception means for receiving the dewatered pulp discharged from the dewatering unit, which receptions means is positioned below said outlet and a stand pipe provided with an inlet, in which stand pipe the pulp falls freely under the influence of gravity, the device being arranged to feed pulp from the reception means to the inlet of the stand pipe, and the reception means is positioned at a higher level than the inlet of the stand pipe, wherein the device comprises at least one feeding down surface which extends from the reception means to the inlet of the stand pipe, in that the feeding down surface is arranged to transport pulp between the reception means and the inlet of the stand pipe by feeding the pulp downwards along and on this feeding down surface under the influence of gravity, and in that the dilution means are arranged to dilute the pulp during the feeding of the pulp downwards along and on the feeding down surface.

21. The device according to claim 20, wherein the feeding down surface is sloped.

* * * * *

UNITED STATES PATENT AND TRADEMARK OFFICE

CERTIFICATE OF CORRECTION

PATENT NO. : 8,038,844 B2
APPLICATION NO. : 12/226466
DATED : October 18, 2011
INVENTOR(S) : Peter Danielsson It is certified that error appears in the above-identified patent and that said Letters Patent is hereby corrected as shown below:

Column 4, line 43, after “several”, insert --plates positioned--.
Column 4, line 44, delete “positioned plates”.
Column 6, line 7, after “arranged” insert --to--.
Column 8, line 50, after “than” insert --the--.
Column 8, line 59, after “9,” insert --wherein--.

Signed and Sealed this
Thirteenth Day of November, 2012

David J. Kappos

David J. Kappos
*Director of the United States Patent and Trademark Office*